US012150526B2

(12) United States Patent
Chayahara

(10) Patent No.: US 12,150,526 B2
(45) Date of Patent: Nov. 26, 2024

(54) SEPARABLE BOTTOM END STOP FOR SLIDE FASTENER

(71) Applicant: YKK Corporation, Tokyo (JP)

(72) Inventor: Yuki Chayahara, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/033,011

(22) PCT Filed: Oct. 28, 2020

(86) PCT No.: PCT/JP2020/040524
§ 371 (c)(1),
(2) Date: Apr. 20, 2023

(87) PCT Pub. No.: WO2022/091268
PCT Pub. Date: May 5, 2022

(65) Prior Publication Data
US 2024/0000199 A1 Jan. 4, 2024

(51) Int. Cl.
*A44B 19/36* (2006.01)

(52) U.S. Cl.
CPC ..... *A44B 19/36* (2013.01)

(58) Field of Classification Search
CPC ..... A44B 19/36; A44B 19/382; A44B 19/388; A44B 19/306
See application file for complete search history.

(56) References Cited

U.S. PATENT DOCUMENTS 6,009,602 A 1/2000 Terada
6,615,458 B2 * 9/2003 Takasawa ..... A44B 19/388 24/433

(Continued)

FOREIGN PATENT DOCUMENTS

JP H11-178615 A 7/1999
JP 3621040 B2 11/2004

(Continued)

OTHER PUBLICATIONS

International Preliminary Report on Patentability received in corresponding International Application No. PCT/JP2020/040524, issued May 2, 2023, in 7 pages.

(Continued)

*Primary Examiner* — Robert Sandy
*Assistant Examiner* — Louis A Mercado
(74) *Attorney, Agent, or Firm* — Procopio, Cory, Hargreaves & Savitch LLP

(57) ABSTRACT

A separable bottom end stop for a reverse opening-type slide fastener, in which left and right element rows of left and right fastener stringers can be opened from an upper end and a lower end, the slide fastener includes a lower slider for opening the left and right element rows from the lower end, the lower slider includes a locking claw, which is elastically biased to a protruded position protruding into an element guide path of the lower slider, an insert pin connected to the lower end of one of the left and right element rows, and a box pin connected to the lower end of the other of the left and right element rows. At least one of the box pin and the insert pin includes a release groove capable of receiving the locking claw on a side surface opposing to the other side surface.

12 Claims, 11 Drawing Sheets

(56) References Cited

U.S. PATENT DOCUMENTS

| | | | | |
|---|---|---|---|---|
| 7,415,753 | B2 * | 8/2008 | Kusayama | A44B 19/382 24/433 |
| 7,694,396 | B2 * | 4/2010 | Ogura | A44B 19/382 24/433 |
| 8,402,614 | B2 * | 3/2013 | Fujii | A44B 19/382 24/433 |
| 8,752,253 | B2 * | 6/2014 | Sato | A44B 19/28 24/429 |
| 8,806,725 | B2 * | 8/2014 | Keyaki | A44B 19/382 24/433 |
| 8,844,101 | B2 * | 9/2014 | Nozaki | A44B 19/382 24/433 |
| 8,959,727 | B2 * | 2/2015 | Keyaki | A44B 19/308 24/421 |
| 8,973,224 | B2 * | 3/2015 | Sato | A44B 19/306 24/415 |
| 9,084,454 | B2 * | 7/2015 | Ogura | A44B 19/12 |
| 2002/0050031 | A1 | 5/2002 | Takasawa et al. | |
| 2006/0282998 | A1 | 12/2006 | Kusayama et al. | |
| 2011/0191989 | A1 | 8/2011 | Fujii | |
| 2011/0197402 | A1 | 8/2011 | Keyaki et al. | |
| 2012/0167354 | A1 * | 7/2012 | Keyaki | A44B 19/388 24/386 |

FOREIGN PATENT DOCUMENTS

| | | | |
|---|---|---|---|
| JP | 2006-346364 | A | 12/2006 |
| JP | 4307413 | B2 | 5/2009 |
| WO | 2010/067459 | A1 | 6/2010 |
| WO | 2010/073362 | A1 | 7/2010 |

OTHER PUBLICATIONS

International Search Report (with translation) and Written Opinion received in corresponding International Application No. PCT/JP2020/040524, mailed Jan. 12, 2021, in 11 pages.

* cited by examiner

SEPARABLE BOTTOM END STOP FOR SLIDE FASTENER

CROSS-REFERENCE TO RELATED APPLICATIONS

This application is a US national stage application of International Application PCT/JP2020/040524, filed Oct. 28, 2020, the contents of which are incorporated by reference.

FIELD OF THE INVENTION

The present invention relates to a separable bottom end stop of a reverse opening-type slide fastener, and more particularly, to a separable bottom end stop comprising a lower slider, an insert pin and a box pin in a slide fastener with a lower slider for reverse opening.

BACKGROUND OF THE INVENTION

A reverse opening-type slide fastener is known in the art, in which an upper slider and a lower slider are attached to each element row of a pair of left and right fastener stringers so that their rear openings face each other. The slide fastener allows for upward opening by pulling downward the upper slider and downward opening by pulling upward the lower slider. Examples of such a reverse opening-type slide fastener are disclosed in Japanese Patent No. 4307413 B (Patent Literature 1), Japanese Patent No. 3621040 B (Patent Literature 2), etc.

In the reverse opening-type slide fastener, when pulling upward the lower slider from its lower end position to a first element split position at which the lower end first elements are split, a resistance to sliding of the lower slider becomes maximum when the first elements are being split. Further, it is found that, in a conventional reverse opening-type slide fastener, there is a second largest resistance generated before the lower slider reaches the first element split position. This second largest resistance is generated as follows. As the lower slider is pulled upward from the lower end position, the locking claw of the lower slider also moves upward, and at a certain time point, the insert pin, the locking claw of the lower slider and a box pin are aligned most closely in a left-and-right width direction in an element guide path of the lower slider. Thereby, the insert pin, the box pin and the locking claw interfere with each other in the width direction, which temporarily increases the resistance to sliding of the lower slider.

The thinner line in FIG. 11 shows a sliding resistance (N) of the lower slider with respect to a displacement (mm) of the lower slider in a conventional reverse opening-type slide fastener, when the lower slider is pulled upward from the lower end position beyond the first element split position. As can be seen from FIG. 11, the resistance is maximum, 13.7 (N) at the first element (zipper tooth) split position. In addition, the second largest resistance of 10.0 (N) is generated at the maximum close position at which the inert pin, the locking claw and the box pin are aligned most closely in the width direction. This second largest resistance is perceived by a user who pulls up the lower slider as a catch on the lower slider, and this catch may be a burden on the user when starting to pull up the lower slider.

PRIOR ART

Patent Literature

[Patent Literature 1] Japanese Patent No. 4307413 B
[Patent Literature 2] Japanese Patent No. 3621040 B

SUMMARY OF THE INVENTION

Technical Problem

In view of the problems as described above, an object of the present invention is to provide a separable bottom end stop for a reverse opening-type slide fastener, which can reduce a catch when a lower slider of the reverse opening-type slide fastener starts to be pulled upward from its lower end position.

Solution to Problem

To solve the above problems, according to an aspect of the present invention, there is provided a separable bottom end stop for a reverse opening-type slide fastener, in which left and right element rows of left and right fastener stringers can be opened from an upper end and a lower end, the slide fastener comprising: a lower slider for opening the left and right element rows from the lower end, the lower slider including a locking claw, which is elastically biased to a protruded position protruding into an element guide path of the lower slider; an insert pin connected to a lower end of one of the left and right element rows; and a box pin connected to a lower end of the other of the left and right element rows, wherein at least one of the box pin and the insert pin includes a release groove capable of receiving the locking claw on a side surface opposing to the other side surface, and wherein at least one of the box pin and the insert pin includes a protruded piece protruding from one side surface toward the other side face, the side surfaces being opposing to each other, and wherein the release groove extends upward at least to a lower end of the protruded piece.

In this specification, "upper" and "lower" are relative terms, and for example, in fabrics such as clothes and bags, a lower slider of the reverse opening-type slide fastener may be arranged on an upper side and an upper slider may be arranged on a lower side. In this specification, the terms "upper" and "lower" are based on a longitudinal direction each of the fastener stringers, the insert pin and the box pin, unless otherwise specified. In addition, one side of a longitudinal direction each of the fastener stringer, the insert pin and the box pin is called "upper", and the other side of the longitudinal direction is called "lower".

An example of the "lower end of the protruded piece" in the present invention is a portion represented by the reference numeral 66*a* in FIG. 2. That is, referring to FIG. 2, a release groove 63 extends upward at least to the lower end 66*a* of a protruded piece 66 in an upper-and-lower direction (the longitudinal direction of the box pin 60). In the present invention, when the lower slider is pulled upward from the lower end position to the first element split position, the locking claw of the lower slider also moves upward, and at a certain time point, the insert pin, the locking claw and the box pin are most closely aligned in the left-and-right width direction in the element guide path of the lower slider. At this time, the locking claw is partially received in the release groove provided on at least one of side surfaces of the box pin and the insert pin. When the lower slider is pulled upward to the first element split position, the locking claw is not displaced in the width direction, and the box pin or insert pin partially receives the locking claw in the release groove while the box pin or insert pin is displaced in the width direction. Thus, it can be said that the locking claw is released relatively in the width direction. Thereby, the total width occupied by the insert pin, the locking claw and the box pin in the width direction can be reduced, so that interference in the width direction among the insert pin, the box pin and the locking claw can be reduced.

According to another aspect of the present invention, there is provided a separable bottom end stop for a reverse opening-type slide fastener, in which left and right element rows of left and right fastener stringers can be opened from an upper end and a lower end, the slide fastener comprising: a lower slider for opening the left and right element rows from the lower end, the lower slider including a locking claw, which is elastically biased to a protruded position protruding into an element guide path of the lower slider; an insert pin connected to a lower end of one of the left and right element rows; and a box pin connected to a lower end of the other of the left and right element rows, wherein at least one of the box pin and the insert pin includes a release groove on a side surface opposing to the other side surface, which is capable of partially receiving the locking claw at a time when upper ends of the box pin and the insert pin become housed in the lower slider through a rear opening, when the lower slider is pulled upward from its lower end position to a first element split position at which lower end first elements are split.

In this invention, when the lower slider is pulled upward from the lower end position to the first element split position, the locking claw of the lower slider also moves upward, and at a certain time point, upper ends, in the longitudinal direction, of the box pin and the insert pin in a stationary state become housed in the lower slider from the rear opening (see FIG. 6). At this time point, the insert pin, the locking claw and the box pin are at their closest position where they are most closely aligned in the left-and-right width direction in the element guide path of the lower slider. At this time, by partially receiving the locking claw in the release groove provided on at least one of the side surfaces of the box pin and the insert pin, the locking claw can be released relatively in the width direction. Thereby, the total width occupied by the insert pin, the locking claw and the box pin in the width direction can be reduced, and interference among the insert pin, the box pin and the locking claw in the width direction can be reduced.

In one embodiment of the present invention, the release groove includes a release portion, which receives most, in a left-and-right width direction the locking claw at the protruded position, and wherein the release portion is arranged upward relative to the locking claw of the lower slider at the lower end position. At the time point when the insert pin, the locking claw and the box pin are at their closest position, the release portion of the release groove receives most, in the left-and-right width direction, the locking claw at the protruded position. In other words, in the release portion of the release groove, the locking claw is most released relatively in the width direction. When the lower slider is at the lower end position, the release portion is spaced upward from the locking claw located at the protruded position. As the lower slider moves upward from the lower end position, the locking claw at the protruded position is approaching the release portion, and then, at the closest position, the locking claw at the protruded position and the release portion are aligned in the width direction.

In one embodiment of the present invention, the release groove includes a guide face capable of guiding the locking claw from the protruded position to a retracted position retracted from the element guide path. When the lower slider is pulled upward from the lower end position to the first element split position, a portion of the locking claw, at the protruded position, of the lower slider enters the release groove, and then the locking claw is guided by the guide face of the release groove from the protruded position to the retracted position against a bias of an elastic member, while moving upward together with the lower slider.

In one embodiment of the present invention, a depth of the release groove in a left-and-right width direction increases from a lower side to an upper side. Thereby, when the slider is pulled upward from the lower end position, the release groove gradually receives the locking claw in the width direction. Therefore, it is easy to introduce the locking claw into the release groove.

In one embodiment of the present invention, the release groove includes an inclined groove bottom face inclined so as to be gradually spaced relative to the locking claw at the protruded position in a left-and-right width direction from a lower blade plate side to an upper blade plate side of the lower slider. When the lower slider is pulled upward from the lower end position to the first element split position, a portion of the locking claw at the protruded position enters the release groove of the lower slider. At this time, the inclined groove bottom face of the release groove is inclined with respect to the locking claw at the protruded position so as to be spaced in the width direction from the lower blade plate side to the upper blade plate side, so that a clearance, in the width direction, between the locking claw and the box pin or the insert pin that includes the release groove increases from the lower blade plate side to the upper blade plate side. Thereby, interference in the width direction among the box pin, the insert pin and the locking claw can be reduced.

In one embodiment of the invention, only the box pin includes the release groove. This embodiment will be described below with reference to the drawings. However, the release groove may be provided in the insert pin or in both the box pin and the insert pin depending a position in the width direction or a size of the locking claw.

Advantageous Effects of Invention

In the present invention, when the lower slider is pulled upward from the lower end position to the first element split position, the locking claw is partially received in the release groove in the width direction, which is provided on at least one of the side surfaces of the box pin and the insert pin, so that the locking claw can be released relatively in the width direction. Thereby, it is possible to reduce interference in the width direction among the insert pin, the box pin and the locking claw, thereby reducing a catch or a load that a user may perceive when starting to pull up the lower slider.

DETAILED DESCRIPTION OF THE INVENTION

Figure 1:
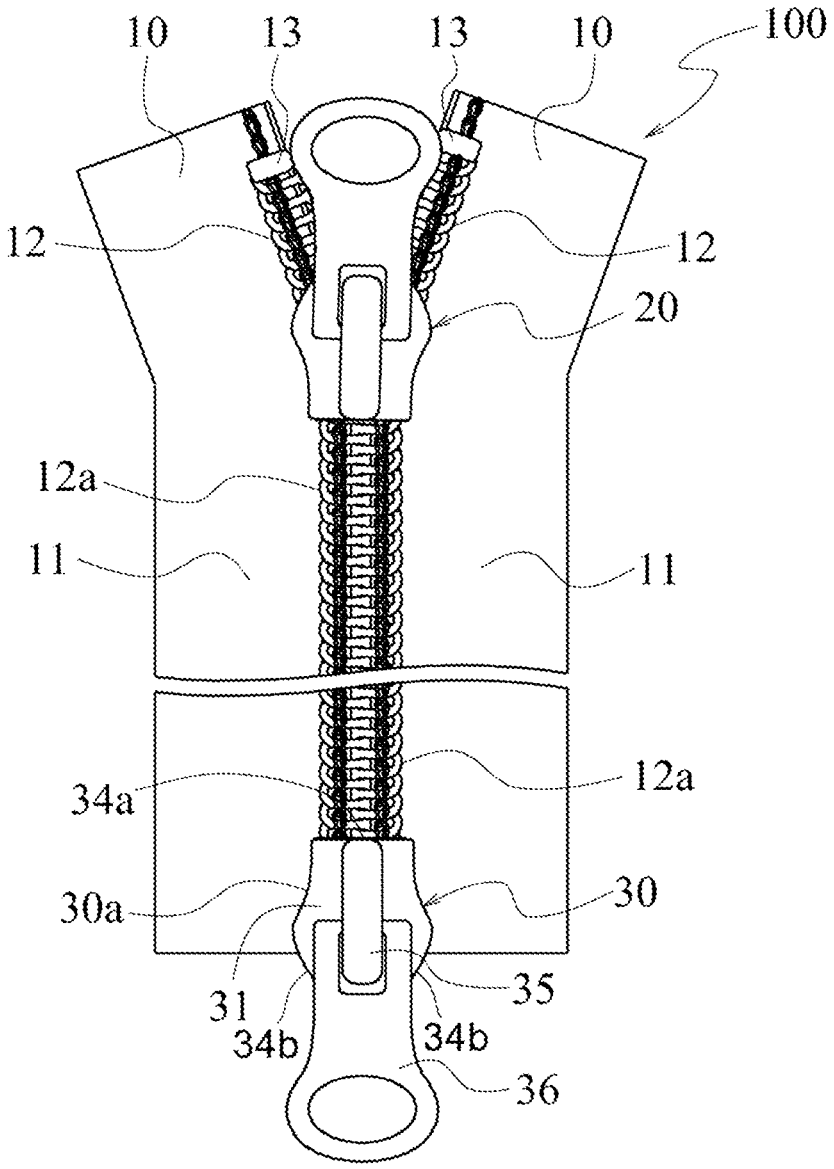
FIG. 1 is a plane view showing a reverse opening-type slide fastener broken in the longitudinal direction (upper-and-lower direction), including a separable bottom end stop for the reverse opening-type slide fastener according to the present invention.

Hereinafter, embodiments of the present invention will be described with reference to the drawings. However, the present invention is not limited to such embodiments, and the embodiments can be appropriately modified within the scope of claims and the range of equivalents. FIG. 1 is a plane view, broken in a longitudinal direction (upper-and-lower direction), showing a reverse opening-type slide fastener (hereinafter also simply referred to as a "slide fastener") 100 including a separable bottom end stop for the reverse opening-type slide fastener according to the present invention. Hereinafter, upper and lower directions of the slide fastener 100 are based on the longitudinal direction of the slide fastener 100 unless otherwise specified. The slide fastener 100 comprises: a pair of right and left fastener stringers 10; an upper slider 20; and a lower slider 30. The left and right fastener stringers 10 include: left and right fastener tapes 11; and element rows 12 each consisting of a series of or a large number of resin or metal elements 12*a* attached to opposing edge portions of the left and right fastener tapes 11. The upper slider 20 is for upward opening to open between the left and right element rows 12 from the upper end. The lower slider 30 is for reverse opening to open between the left and right element rows 12 from the lower end. The upper and lower sliders 20, 30 are attached to the left and right element rows 12 so that their rear openings (34*a*) face each other.

Figure 4:
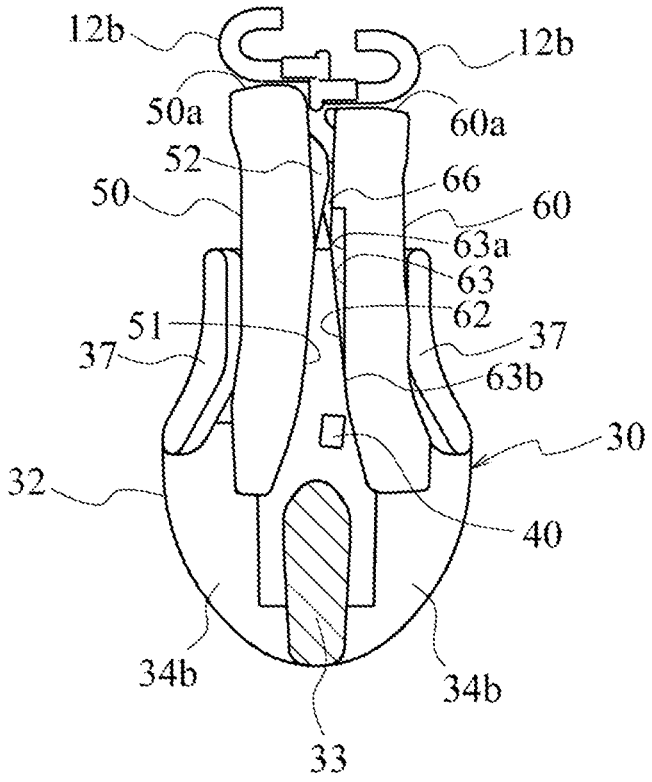
FIG. 4 is a plane view showing a lower slider at its lower end position, which omits an upper blade plate, etc.
Figure 8:
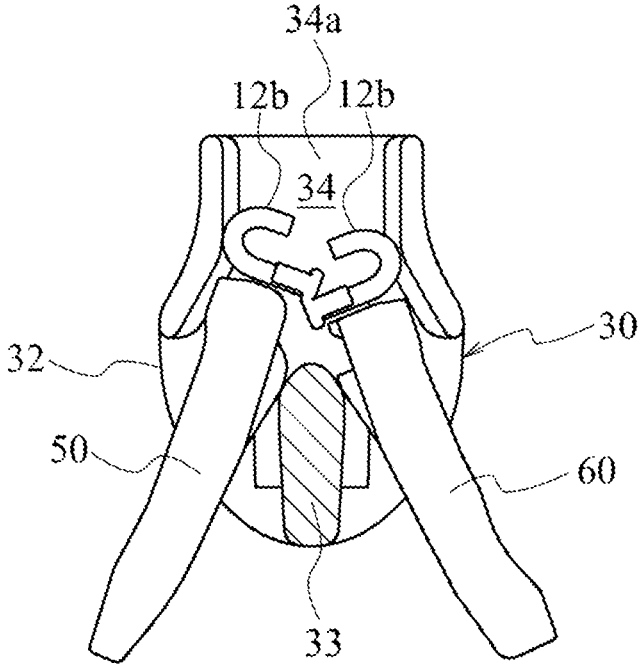
FIG. 8 is a plane view similar to FIG. 4, showing a state where the lower slider has arrived at a first element split position.

The upper and lower sliders 20, 30 are substantially the same except for a release groove 63 of a box pin 60, which will be described later. Therefore, the structure of the lower slider 30 will be described below, and descriptions of the structure of the upper slider 20 will be omitted. The lower slider 30 comprises a body 30*a* and a pull tab 36. The body 30*a* comprises: an upper blade plate 31; a lower blade plate 32 (see FIG. 4, etc.); and a guide pillar 33 for connecting between the upper blade plate 31 and the lower blade plate 32 (see FIG. 4, etc.). Between the upper and lower blade plates 31, 32, a Y-shaped element guide path 34 (see FIGS. 8, 9, etc.) is defined. The element guide path 34 is open at a rear opening 34*a* of the lower slider 30 and is open at two shoulder openings 34*b* adjacent to the guide pillar 33 on its left and right sides. The Y-shaped element guide path 34 is divided into a branched portion on the two shoulder openings 34*b* side and a non-branched portion on the rear opening 34*a* side. A left-and-right width in the non-branched portion of the element guide path 34 is defined by flanges 37 of the upper and lower blade plates 31, 32 (only the flange 37 of the lower blade plate is shown in FIG. 4, etc.). On the front surface of the upper blade plate 31, a pull tab connecting portion 35 is provided, and the pull tab 36 is connected to the pull tab connecting portion 35. When a user grips the pull tab 36 and pulls the lower slider 30 upward and downward in the longitudinal direction of the slide fastener 100, the lower slider 30 slides upward and downward so as to open and close between the left and right element rows 12.

Figure 9:
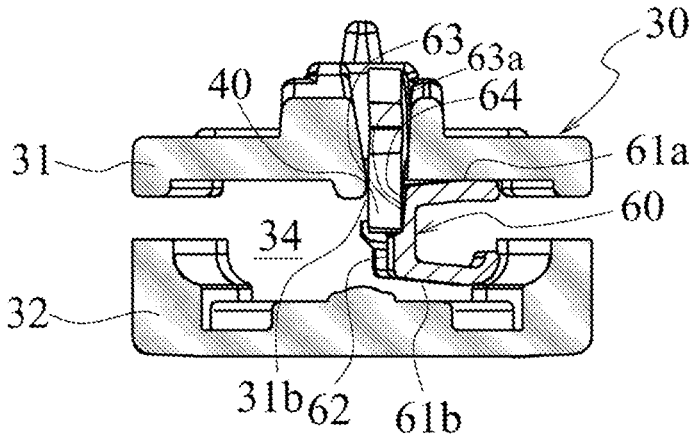
FIG. 9 is a cross-sectional view of the lower slider taken along the line B-B of FIG. 6, omitting the insert pin.
Figure 10:
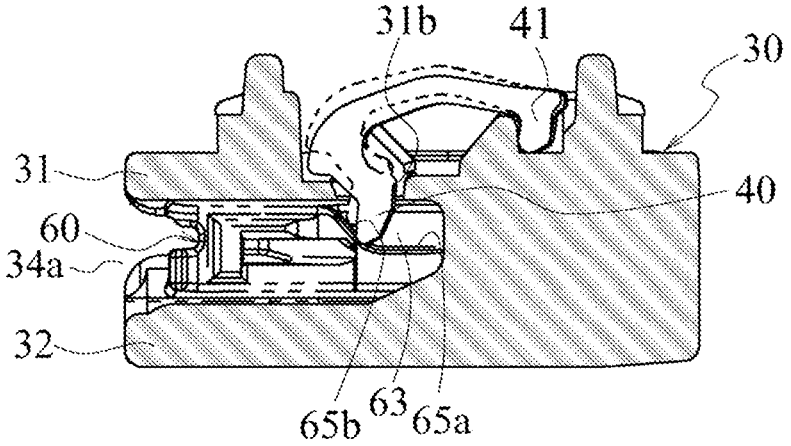
FIG. 10 is a view seen from a cross section taken along the line C-C of FIG. 6, showing a time point when a locking claw has moved from a horizontal groove side face of the release groove to a guide face.

The lower slider 30 includes a locking claw 40 (see FIGS. 9, 10, etc.). The locking claw 40 is always biased toward a protruded position protruding into the element guide path 34 through an opening 31*b* (see FIGS. 9 and 10) that penetrates the upper blade plate 31, by a leaf spring (not shown) as an elastic member arranged in the pull tab connecting portion 35. The locking claw 40 at the protruded position contacts elements 12*a* present in the element guide path 34, which acts as a resistance to sliding of the lower slider 30. A proximal portion 41 (see FIG. 10) of the locking claw 40 is fixed to the upper blade plate 31. When a user grips the pull tab 36 and raises it from its fallen state, the locking claw 40 is retracted from the protruded position to a retracted position, which is out of the element guide path 34, against the bias of the leaf spring. As a result, the locking claw 40 is unlocked, thereby enabling the lower slider 30 to move upward and downward. The above descriptions of the lower slider 30 substantially apply to the upper slider 20 as well.

Each fastener stringer 10 includes a top stop 13 provided to an upper end of each element row 12. The top stop 13 restricts any further upward movement of the upper slider 20. Further, the left fastener stringer 10 includes: an insert pin 50 (see FIG. 4, etc.) consecutively provided to a lower end of the left element row 12; and a box pin 60 (see FIG. 4, etc.) consecutively provided to a lower end of the right element row 12. The insert pin 50 and the box pin 60 are formed, for example, by injection molding or extrusion molding a thermoplastic resin such as polyacetal, polyamide, polypropylene, polybutylene terephthalate or the like onto the left and right fastener tapes 11. The insert pin 50 and the box pin 60 restrict further downward movement of the lower slider 30.

Figure 2:
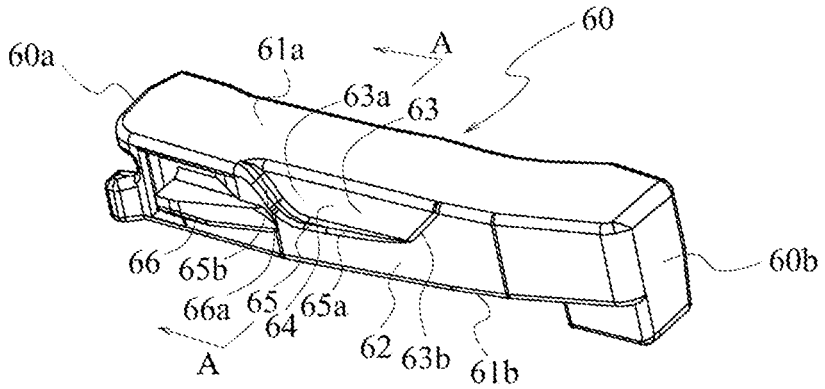
FIG. 2 is a perspective view of a box pin.
Figure 3:
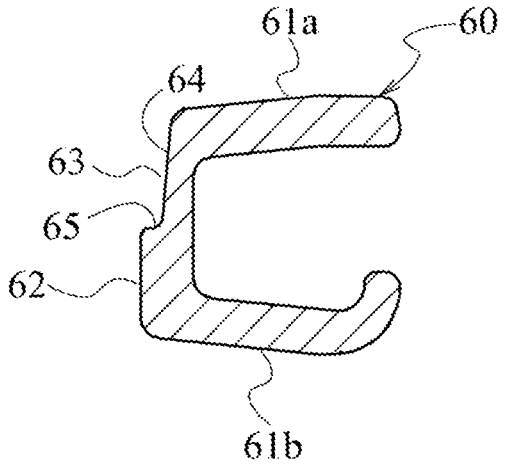
FIG. 3 is a cross-sectional view of the box pin taken along the line A-A of FIG. 2.

FIG. 2 is a perspective view of the box pin 60. FIG. 3 is a cross-sectional view of the box pin 60 taken along the line A-A in FIG. 2. The box pin 60 includes: an upper end surface which is one end surface in the longitudinal direction of the box pin 60; a lower end surface which is the other end surface, in the longitudinal direction, of the box pin 60; a front surface 61*a*; a back surface 61*b*; and a side surface 62 opposing to the insert pin 50. The upper end surface 60*a* is an upper end, in the longitudinal direction, of the box pin 60. The longitudinal direction of the box pin 60 (and the insert pin 50) is substantially along the longitudinal direction of the slide fastener 100. Referring to FIG. 3, a cross-section, perpendicular to the longitudinal direction, of the box pin 60 is substantially U-shaped over mostly between the upper and lower end surfaces 60*a*, 60*b*. In a hollow interior of the box pin 60, there is an end portion, in the width direction, of the fastener tape 11 (not shown). Also, the front surface 61*a* of the box pin 60 is the surface on the upper blade plate 31 side of the lower slider 30, and the back surface 61*b* is the surface on the lower blade plate 32 side. Hereinafter, the direction perpendicular to the longitudinal direction and connecting between the front surface 61*a* and the back side surface 61 is referred to as a front-and-back direction.

On the side surface 62 of the box pin 60, a release groove 63 and a protruded piece 66. The release groove 63 is recessed rightward from the side surface 62 and extends to the front surface 61*a*. The depth of the release groove 63 recessed rightward from the side surface 62 gradually increases from the lower side to the upper side in the longitudinal direction. A portion corresponding to the release groove 63 on the front surface 61*a* is cut out. The release groove 63 is provided in a substantially middle portion between the upper end surface 60*a* and the lower end surface 60*b* of the box pin 60, and is elongated in the longitudinal direction of the box pin 60. The reference numeral 63*b* in FIG. 2 is a lower end of the release groove 63, and the reference numeral 66*a* is a lower end of the protruded piece 66. The release groove 63 extends upward from the lower end 63*b* beyond the lower end 66*a* of the protruded piece 66. The height of the protruded piece 66 leftward from the side surface 62 gradually increases upward from the lower end 66*a*. The length of the release groove 63 in the longitudinal direction is approximately ⅓ of the length of the box pin 60 in the longitudinal direction (the length between the upper end surface 60*a* and the lower end surface 60*b*). Also, the release groove 63 is formed, on the side surface 62 of the box pin 60, over an approximately half portion on the front surface 61*a* side in the front-and-back direction. The release groove 63 has a substantially trapezoidal groove bottom face (inclined groove bottom face) 64, which is a bottom of the groove recessed rightward from the side surface 62, and a groove side face 65 connecting between the groove bottom face 64 and the side surface 62. As can be seen from FIG. 3, the groove bottom face 64 is slightly inclined rightward in the width direction from the end (the boundary with the groove side face 65) on the back surface 61*b* side in the front-and-back direction to the front surface 61*a* side. In other words, the groove bottom face 64 is inclined so as to be gradually and slightly spaced, in the width direction, from the side surface 62 (or relative to the insert pin 50 and the locking claw 40 (not shown) at the protruded position) from the boundary with the groove side face 65 to the front surface 61*a* side. Therefore, the groove bottom face 64 is hereinafter referred to as an inclined groove bottom face 64. The groove side face 65 includes: a horizontal groove side face 65*a* on the downward side in the longitudinal direction, which is substantially parallel to the front surface 61*a* (or the back surface 61*b*); and a guide face 65*b* as an inclined groove side face, which extends obliquely upward (on the upper end surface 60*a* side) in the longitudinal direction from the horizontal groove side face 65*a* and toward the front surface 61*a* side in the front-and-back direction. The horizontal groove side face 65*a* is curvedly connected to the guide face 65*b*. In the upper-and-lower direction, the boundary between the horizontal groove side face 65*a* and the guide face 65*b* is located at the lower end 66*a* of the protruded piece 66. The horizontal groove side face 65*a* is set to be slightly closer to the back surface 61*b* than the protruding end of the locking claw 40 at the protruded position, in the front-and-back direction. Further, a left-and-right width (depth from the side surface 62) of the horizontal groove side face 65*a* gradually widens upward in the longitudinal direction from the lower end 63*b* of the release groove 63. The horizontal groove side face 65*a* and the guide face 65*b* are gently connected with each other. The release groove 63 includes a release portion 63*a*, at which a depth recessed rightward from the side surface 62 is deepest in a position adjacent downward to the guide face 65*b*. The release portion 63*a* is located at a position corresponding to an upper (guide face 65*b* side) end on the horizontal groove side face 65*a* in the upper-and-lower direction. The release portion 63*a* can receive the locking claw 40 at the protruded position on the rightmost side.

Referring to FIG. 4, etc., the insert pin 50 includes: an upper end surface 50*a* that is its upper end in the longitudinal direction; and a side surface 51 opposing to the box pin 60. There is provided a protruded piece 52 protruding rightward, toward the box pin 60 on an upper side of the side surface 51 of the insert pin 50. The protruded piece 52 of the insert pin 50 and the protruded piece 66 of the box pin 60 partially overlap in the front-and-back direction so as to restrict a displacement of the insert pin 50 and the box pin 60 in the front-and-back direction, and also restrict further downward displacement of the insert pin 50 or the box pin 60 relative to the lower slider 30, when the lower slider 30 is at the lower end position (see FIG. 4).

FIGS. 4 to 8 are plane views showing steps of pulling upward the lower slider 30 from the lower end position of the lower slider 30 (see FIG. 4) to a first element split position (FIG. 8), where the first elements 12*b* which are the elements at the lower ends of the left and right element rows 12 are split. The upper blade plate 31 is omitted in those FIGS. The left and right fastener tapes 11 are also omitted in FIGS. 4 to 8. The lower slider 30 moves upward in the longitudinal direction from its lower end position to the first element split position, whereas the insert pin 50 and the box pin 60 are at the same position in the longitudinal direction. At this time, the locking claw 40 also moves upward together with the lower slider 30, whereas the locking claw 40 is not displaced in the left-and-right direction. In this embodiment, the lower end position of the lower slider 30 is the position where the lower slider 30 is restricted from further moving downward by the insert pin 50 and the box pin 60. In a state where the lower slider 30 is at the lower end position (see FIG. 4), the left and right element rows 12 between the lower slider 30 and the upper slider 20 are closed. At the lower end position of the lower slider 30, upper portions of the insert pin 50 and the box pin 60 are exposed the longest and upward from the rear opening 34*a* of the lower slider 30. The exposed, upper portions of the insert pin 50 and the box pin 60 from the lower slider 30 gradually reduces as the lower slider 30 is pulled upward (see FIGS. 5 and 6). At the time point of FIG. 6, the upper end surfaces 50*a*, 60*a* of the insert pin 50 and the box pin 60, respectively, become housed in the lower slider 30 through the rear opening 34*a* (which is in a state where the insert pin 50 and the box pin 60 are least exposed outside the lower slider 30). At this time point, as will be described later, the insert pin 50, the locking claw 40 and the box pin 60 are located most closely in the left-and-right width direction in the element guide path 34 of the lower slider 30. When the lower slider 30 moves further upward from this time point, lower portions of the insert pin 50 and the box pin 60 begin to be exposed downward from the left and right shoulder openings 34*b* of the lower slider 30 (see FIG. 7), and the lower slider 30 arrives at the first element split position (see FIG. 8).

In this embodiment, as can be seen from FIG. 4, etc., the locking claw 40 is positioned slightly rightward from the left-and-right midpoint of the lower slider 30 in the width direction, that is, on the box pin 60 side. The opening 31*b* (see FIG. 9, etc.) of the upper blade plate 31 through which the locking claw 40 is passed is also provided on the right side of the left-and-right midpoint. Therefore, in this embodiment, the release groove 63 for releasing the locking claw 40 is formed in the box pin 60. Referring to FIG. 4, in a state where the lower slider 30 is at its lower end position, the release portion 63*a* of the release groove 63 of the box pin 60 is arranged so as to be spaced upward from the locking claw 40 at the protruded position. In other words, the locking claw 40 of the lower slider 30 at the lower end position and the release portion 63*a* of the release groove 63 of the box pin 60 are positioned apart from each other in the longitudinal direction. Further, in a state where the lower slider 30 is at the lower end position, the lower end 63*b* of the release groove 63 is also positioned upward relative to the locking claw 40. In this embodiment, although the entire release groove 63 is spaced upward relative to the locking claw 40 at the time point of FIG. 4, the lower end 63*b* of the release groove 63 may be positioned at substantially the same up-and-down position as the locking claw 40 or further downward.

Figure 5:
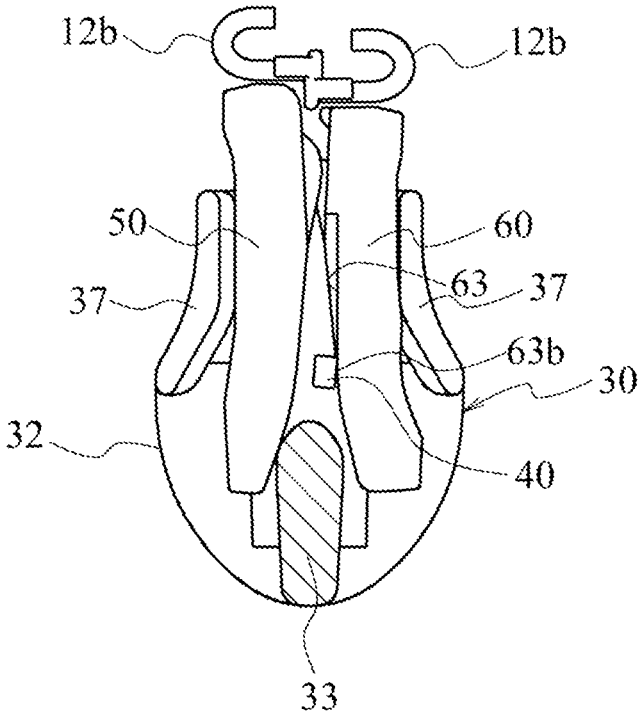
FIG. 5 is a plane view similar to FIG. 4, showing a state where the lower slider has been pulled upward from the lower end position and a locking claw is approaching a release groove of the box pin.
Figure 6:
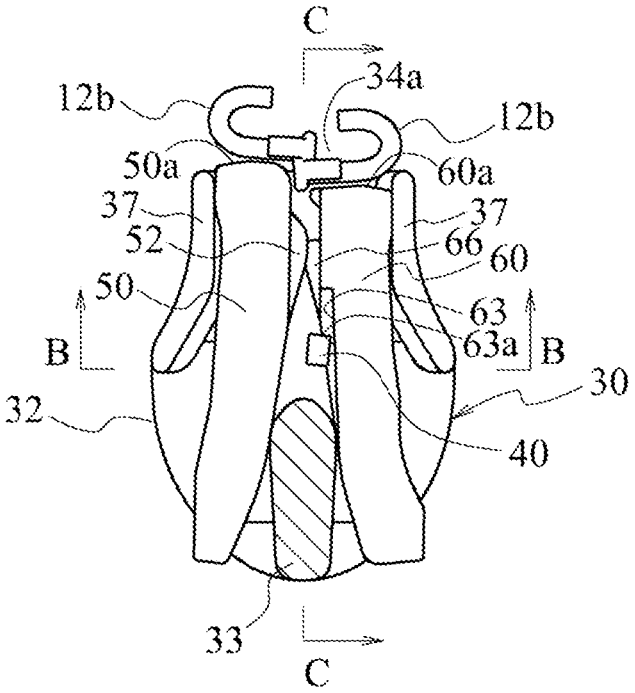
FIG. 6 is a plane view similar to FIG. 4, showing a state where a portion of the locking claw of the lower slider has entered the release groove of the box pin.

As the lower slider 30 starts to be pulled upward from the lower end position in FIG. 4, the locking claw 40 at the protruded position is approaching the lower end 63*b* of the release groove 63 of the box pin 60 as shown in FIG. 5. When the lower slider 30 moves further upward from this point, the insert pin 50 and the box pin 60 restrained between the left and right flanges 37 are slightly displaced in the width direction so as to get closer to each other. Thereby, the release groove 63 of the box pin 60 partially receives the locking claw 40 at the protruded position. Since the depth of the release groove 63 gradually increases upward from the lower end 63*b*, it is easy to introduce the locking claw 40 into the release groove 63. When the lower slider 30 moves further upward from the time point of FIG. 5, at a certain time point, the upper end surfaces 60*a* of the insert pin 50 and the box pin 60 become housed in the lower slider 30 through the rear opening 34*a* as shown in FIG. 6. In this state, the insert pin 50, the locking claw 40 and the box pin 60 are in a position where they are most closely aligned in the width direction in the element guide path 34 of the lower slider 30, that is, between the left and right flanges 37. At this time, as shown in FIG. 6 (and FIG. 9), a portion of the locking claw 40 is received in the release portion 63*a*, which is deepest rightward in the release groove 63 of the box pin 60. FIG. 9 is a cross-sectional view of the upper slider 20 taken along the line B-B of FIG. 6. In FIG. 9, the insert pin 50 is omitted. At the time point when the insert pin 50, the locking claw 40 and the box pin 60 are at their closest position, as shown in FIGS. 6 and 9, a portion of the locking claw at the protruded position is received in the release portion 63*a* of the release groove 63, so that it is possible to release the locking claw 40 rightmost relatively in the width direction. The total width occupied by the insert pin 50, the locking claw 40 and the box pin 60 in the width direction can be reduced by the amount of partial reception of the locking claw 40 by the release portion 63*a* of the release groove 63. Thereby, it is possible to reduce interference in the width direction among the insert pin 50, the box pin 60 and the locking claw 40.

At the time point of FIGS. 6 and 9, the locking claw 40 is partially put on the horizontal groove side face 65*a* of the release groove 63 and approaches and faces the inclined groove bottom face 64 of the release groove 63. A surface of the locking claw 40 facing the inclined groove bottom face 64 is perpendicular respectively to the upper-and lower direction and the left-and-right direction. At this time, since the inclined groove bottom face 64 of the release groove 63 is inclined toward the upper blade plate 31 in the front-and-back direction so as to be gradually and slightly spaced, in the width direction, relative to the locking claw 40 at the protruded position, a clearance between the locking claw 40 and the box pin 60 (inclined groove bottom face 64) in the width direction increases from the lower blade plate 32 side to the upper blade plate 31 side in the front-and-back direction. Thereby, it is possible to reduce interference between the box pin 60 and the locking claw 40 in the width direction.

Figure 7:
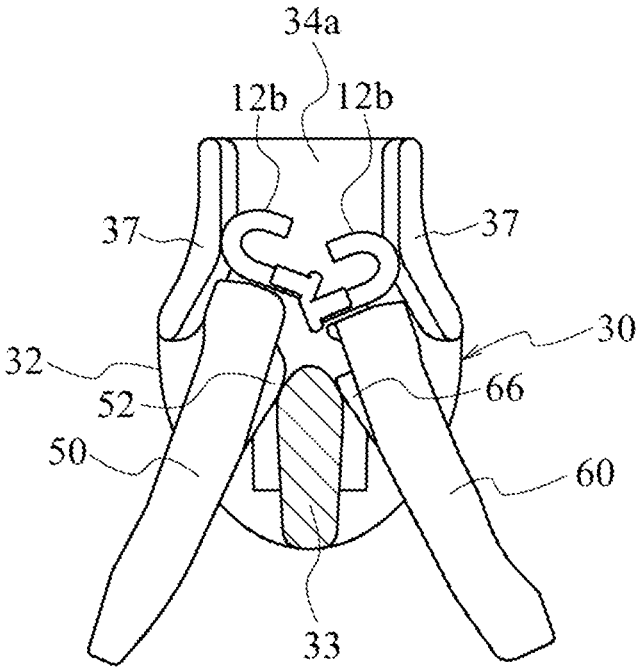
FIG. 7 is a plane view similar to FIG. 4, showing a state where the locking claw of the lower slider has been displaced to a retracted position.

When the lower slider 30 moves further upward from the time point of FIG. 6 to the time point of FIG. 7, the locking claw 40 also moves upward. At this time, the portion of the locking claw 40 that has entered the release groove 63 slides on the horizontal groove side face 65*a* of the release groove 63 and then transfers onto the guide face 65*b* of the release groove 63. FIG. 10 is a view as seen from a cross-section taken along the line C-C of FIG. 6, which shows a time point when the locking claw 40 has moved to the guide face 65*b* of the release groove 63 from the horizontal groove side face 65*a*. When the lower slider 30 further moves upward from the time point of FIG. 10, as indicated by the dashed line in FIG. 10, the locking claw 40 is guided toward the upper blade plate 31 side in the front-and-back direction by the guide face 65*b* of the release groove 63 while sliding on the guide face 65*b*. Thereby, the locking claw 40 is displaced from the protruded position to the retracted position that is out of the element guide path 34 of the lower slider 30 against the urging of the plate spring. FIG. 7 shows the time point when the locking claw 40 is displaced to the retracted position. When the lower slider 30 is further pulled up from the time point of FIG. 7, the lower slider 30 reaches the first element splitting position shown in FIG. 8 to split the first elements 12*b*.

Figure 11:
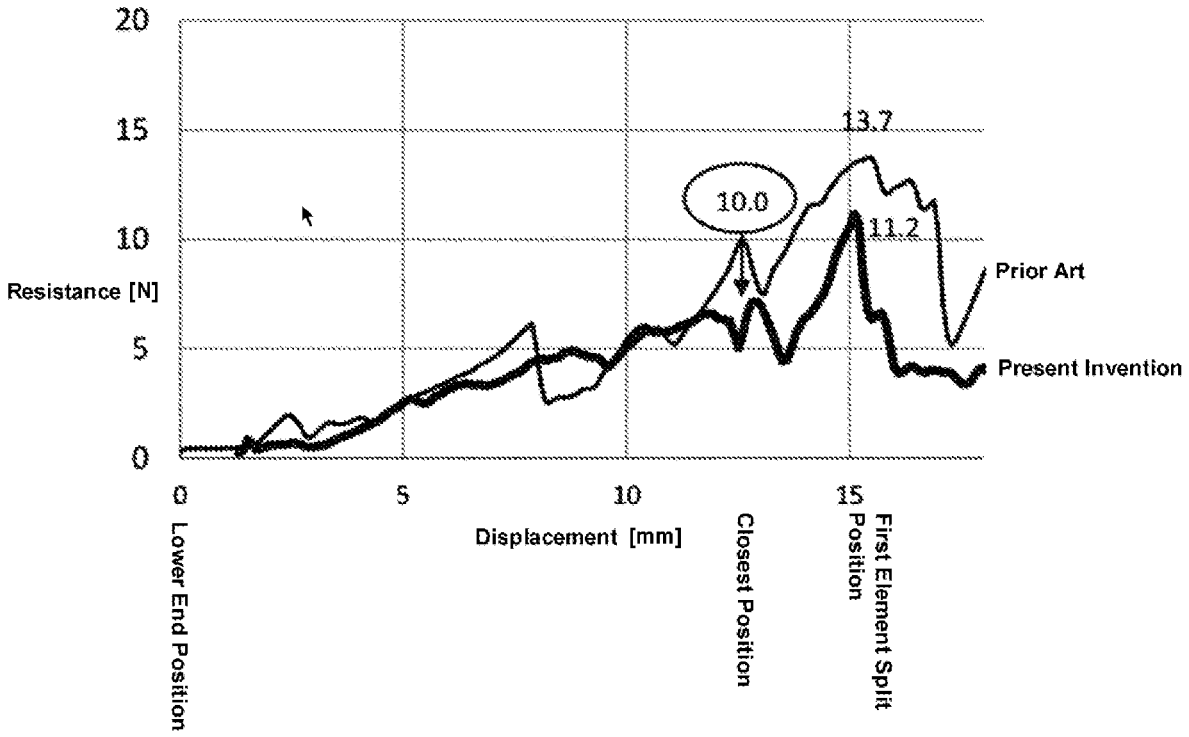
FIG. 11 is a graph showing a sliding resistance (N) of the lower slider with respect to a displacement (mm) of a lower slider, in a conventional reverse opening-type slide fastener (thinner line) and in the reverse opening-type slide fastener of the present invention (thicker line), when the lower slider is pulled upward from the lower end position beyond the first element split position.

The thicker line in FIG. 11 shows a sliding resistance (N) of the lower slider 30 as a function of a displacement (mm) of the lower slider 30 when the lower slider 30 in the reverse opening-type slide fastener 100 as described above is pulled up from the lower end position beyond the first element splitting position. As can be seen from FIG. 11, the maximum resistance is 11.2 (N) at the first element splitting position. Further, before the lower slider 30 reaches the first element splitting position, at the maximum close position where the insert pin 50, the locking claw 40 and the box pin 60 are most closely aligned in the width direction, the prior art generated the resistance of 10.0 (N) which was the second largest resistance, but the lower slider does not substantially generate such second largest resistance, because the locking claw 40 can be relatively released by the release groove 63 provided in the box pin 60. This can reduce catching and load when starting to pull up the lower slider 30 in the reverse opening-type slide fastener 100 from the lower end position.

While the above embodiments include an example in which the release groove 63 is provided in the box pin 60, the release groove may be provided in the insert pin or the release grooves may be provided in both the insert pin and the box pin in the case where the locking claw 40 is located leftward from the middle point in the width direction, or in the case where the left-right arrangement of the insert pin and the box pin is reversed, or the like.

DESCRIPTION OF REFERENCE NUMERALS

10 fastener stringer
11 fastener tape
12 element row
12*a* element
12*b* first element
13 top stop
20 upper slider
30 lower slider
30*a* body
31 upper blade plate
32 lower blade plate
33 guide pillar
34 element guide path
34*a* rear opening
34*b* shoulder opening
35 pull tab connecting portion
36 pull tab
40 locking claw
50 insert pin
50*a* upper end surface (upper end) of insert pin
51 side surface of insert pin
52 protruded piece
60 box pin
60*a* upper end surface (upper end) of box pin
62 side surface of box pin
63 release groove
63*a* release portion
64 inclined groove bottom face (groove bottom face)
65 groove side face
65*a* horizontal groove side face
guide face (inclined groove side face)
66 protruded piece
100 reverse opening-type slide fastener

The invention claimed is:

1. A separable bottom end stop for a reverse opening-type slide fastener (100), in which left and right element rows (12) of left and right fastener stringers (10) can be opened from an upper end and a lower end, the slide fastener (100) comprising:

a lower slider (30) for opening the left and right element rows (12) from the lower end, the lower slider (30) including a locking claw (40), which is elastically biased to a protruded position protruding into an element guide path (34) of the lower slider (30);

an insert pin (50) connected to the lower end of one of the left and right element rows (12); and a box pin (60) connected to the lower end of the other of the left and right element rows (12), wherein at least one of the box pin (60) and the insert pin (50) includes a release groove (63) capable of receiving the locking claw (40) on a side surface (62) opposing to the other side surface, wherein at least one of the box pin (60) and the insert pin (50) includes a protruded piece (66) protruding from one side surface (62) toward the other side surface (51), the side surfaces (62, 51) being opposing to each other, wherein the release groove (63) extends upward at least to a lower end of the protruded piece (66), and wherein the release groove (63) includes a guide face (65*b*) as an inclined groove side face, which extends obliquely upward in a longitudinal direction and toward a front side in a front-and-back direction.

2. The separable bottom end stop for the reverse opening-type slide fastener according to claim 1, wherein the release groove (63) includes a release portion (63*a*), which receives most, in a left-and-right width direction, the locking claw (40) at the protruded position, and wherein the release portion (63*a*) is arranged upward relative to the locking claw (40) of the lower slider (30) at a lower end position.

3. The separable bottom end stop for the reverse opening-type slide fastener according to claim 1, wherein the guide face (65*b*) is capable of guiding the locking claw (40) from the protruded position to a retracted position retracted from the element guide path (34).

4. The separable bottom end stop for the reverse opening-type slide fastener according to claim 1, wherein a depth of the release groove (63) in a left-and-right width direction increases from a lower side to an upper side.

5. The separable bottom end stop for the reverse opening-type slide fastener according to claim 1, wherein the release groove (63) includes an inclined groove bottom face (64) inclined so as to be gradually spaced relative to the locking claw (40) at the protruded position in a left-and-right width direction from a lower blade plate (32) side to an upper blade plate (31) side of the lower slider (30).

6. The separable bottom end stop for the reverse opening-type slide fastener according to claim 1, wherein only the box pin (60) includes the release groove (63).

7. A separable bottom end stop for a reverse opening-type slide fastener (100), in which left and right element rows (12) of left and right fastener stringers (10) can be opened from an upper end and a lower end, the slide fastener (100) comprising:

a lower slider (30) for opening the left and right element rows (12) from the lower end, the lower slider (30) including a locking claw (40), which is elastically biased to a protruded position protruding into an element guide path (34) of the lower slider (30);

an insert pin (50) connected to the lower end of one of the left and right element rows (12); and a box pin (60) connected to the lower end of the other of the left and right element rows (12), wherein at least one of the box pin (60) and the insert pin (50) includes a release groove (63) on a side surface (62) opposing to the other side surface, which is capable of partially receiving the locking claw (40) at a time when upper ends of the box pin (60) and the insert pin (50) become housed in the lower slider (30) through a rear opening (34*a*), when the lower slider (30) is pulled upward from its lower end position to a first element split position at which lower end first elements (12*b*) are split, and wherein the release groove (63) includes a guide face (65*b*) as an inclined groove side face, which extends obliquely upward in a longitudinal direction and toward a front side in a front-and-back direction.

8. The separable bottom end stop for the reverse opening-type slide fastener according to claim 2, wherein the release groove (63) includes a release portion (63*a*), which receives most, in a left-and-right width direction, the locking claw (40) at the protruded position, and wherein the release portion (63*a*) is arranged upward relative to the locking claw (40) of the lower slider (30) at the lower end position.

9. The separable bottom end stop for the reverse opening-type slide fastener according to claim 2, wherein the guide face (65*b*) is capable of guiding the locking claw (40) from the protruded position to a retracted position retracted from the element guide path (34).

10. The separable bottom end stop for the reverse opening-type slide fastener according to claim 2, wherein a depth of the release groove (63) in a left-and-right width direction increases from a lower side to an upper side.

11. The separable bottom end stop for the reverse opening-type slide fastener according to claim 2, wherein the release groove (63) includes an inclined groove bottom face (64) inclined so as to be gradually spaced relative to the locking claw (40) at the protruded position in a left-and-right width direction from a lower blade plate (32) side to an upper blade plate (31) side of the lower slider (30).

12. The separable bottom end stop for the reverse opening-type slide fastener according to claim 2, wherein only the box pin (60) includes the release groove (63).

* * * * *